US007700912B2

(12) United States Patent
Amster et al.

(10) Patent No.: US 7,700,912 B2
(45) Date of Patent: Apr. 20, 2010

(54) MASS SPECTROMETRY CALIBRATION METHODS

(75) Inventors: I. Jonathan Amster, Athens, GA (US); Richard L. Wong, Ewing, NJ (US)

(73) Assignee: University of Georgia Research Foundation, Inc., Athens, GA (US)

( * ) Notice: Subject to any disclaimer, the term of this patent is extended or adjusted under 35 U.S.C. 154(b) by 480 days.

(21) Appl. No.: 11/807,555

(22) Filed: May 29, 2007

(65) Prior Publication Data

US 2008/0067346 A1 Mar. 20, 2008

Related U.S. Application Data

(60) Provisional application No. 60/808,596, filed on May 26, 2006.

(51) Int. Cl.
*H01J 49/00* (2006.01)

(52) U.S. Cl. ..... 250/282; 250/252.1; 250/281

(58) Field of Classification Search ..... 250/281, 250/282, 252.1; 702/19, 22, 23, 24, 25, 26, 702/27, 28

See application file for complete search history.

(56) References Cited

U.S. PATENT DOCUMENTS

2005/0139763 A1* 6/2005 Nagai et al. ..... 250/287
2005/0279926 A1* 12/2005 Terui et al. ..... 250/287
2006/0243901 A1* 11/2006 Barket et al. ..... 250/288

* cited by examiner

*Primary Examiner*—Jack I Berman
*Assistant Examiner*—Nicole Ippolito Rausch
(74) *Attorney, Agent, or Firm*—Thomas, Kayden, Horstemeyer & Risley, LLP

(57) ABSTRACT

Briefly described, embodiments of this disclosure include methods of calibrating a mass spectrometry system, and the like. One exemplary method of calibrating a mass spectrometry system, among others, includes: acquiring a first mass spectrum of a sample using a first trapping potential, wherein the first mass spectrum is acquired from a low ion population, wherein the first mass spectrum includes a first set of mass ion values; and acquiring a second mass spectrum of the sample using a second trapping potential, wherein the second mass spectrum is acquired from a high ion population, wherein the second mass spectrum includes a second set of mass ion values, wherein the first trapping potential is lower than the second trapping potential, wherein the first set of mass ion values is more accurate than the second set of mass ion values, wherein the second set of ion values has a greater signal-to-noise value and a greater detection dynamic range than the first set of mass values, and wherein the first set of mass values is used to calibrate the second set of mass values.

5 Claims, 6 Drawing Sheets

MASS SPECTROMETRY CALIBRATION METHODS

CROSS-REFERENCE TO RELATED APPLICATION

This application claims priority to U.S. provisional applications entitled, "MASS SPECTROMETRY CALIBRATION METHODS," having Ser. No. 60/808,596, filed on May 26, 2006, which is entirely incorporated herein by reference.

BACKGROUND

A mass spectrometry system is an analytical system used for quantitative and qualitative determination of the compounds of materials such as chemical mixtures and biological samples. The mass spectrometry system may include a quadrupole (Q) mass analyzer system, an ion trap mass analyzer system (IT-MS), an ion cyclotron resonance mass analyzer system (ICR-MS), an orbitrap system, and the like.

In general, a mass spectrometry system uses an ion source to produce electrically charged particles such as molecular and/or atomic ions from the material to be analyzed. Once produced, the electrically charged particles are introduced to the mass spectrometer and separated by a mass analyzer based on their respective mass-to-charge ratios. The abundances of the separated electrically charged particles are then detected and a mass spectrum of the material is produced. The mass spectrum is analogous to a fingerprint of the sample material being analyzed. The mass spectrum provides information about the mass-to-charge ratio of a particular compound in a mixture sample and, in some cases, the molecular structure of that component in the mixture.

However, the accuracy of mass measurements using mass spectrometry systems can be problematic. Calibration methods are widely used to improve the accuracy mass measurements, but many are experimentally complex. Thus, there is a need in the industry to find improved and less complex calibration methods.

SUMMARY

Briefly described, embodiments of this disclosure include methods of calibrating a mass spectrometry system, and the like. One exemplary method of calibrating a mass spectrometry system, among others, includes: acquiring a first mass spectrum of a sample using a first trapping potential, wherein the first mass spectrum are acquired from a low ion population, wherein the first mass spectrum include a first set of mass ion values; and acquiring a second mass spectrum of the sample using a second trapping potential, wherein the second mass spectrum is acquired from a high ion population, wherein the second mass spectrum includes a second set of mass ion values, wherein the first trapping potential is lower than the second trapping potential, wherein the first set of mass ion values are more accurate than the second set of mass ion values, wherein the second set of ion values has a greater signal-to-noise value and a greater detection dynamic range than the first set of mass values, and wherein the first set of mass values is used to calibrate the second set of mass values.

BRIEF DESCRIPTION OF THE DRAWINGS

The components in the drawings are not necessarily to scale. Moreover, in the drawings, like reference numerals designate corresponding parts throughout the several views.

FIG. 1(*b*) illustrates a mass spectrum of BSA digest measured with high mass enhancing conditions. FIG. 1(*c*) illustrates a mass spectrum of ovalbumin digest measured using high mass enhancing conditions. Peaks labeled with their nominal mass values are used for calibration points and for error assessment, whereas the peaks marked with open circles are only for error assessment, and their nominal mass values are listed on the top left of the spectra.

FIG. 2(*a*) illustrates the root-mean-square error, FIG. 2(*b*) illustrates the average error, FIG. 2(*c*) illustrates the standard deviation of calibrant masses are plotted against total ion intensity for each spectrum, FIG. 2(*d*) illustrates the root-mean-square error, FIG. 2(*e*) illustrates the average error, and FIG. 2(*f*) illustrates the standard deviation of noncalibrant masses are plotted against total ion intensity for each spectrum. Errors of external (triangles), internal (circles) and stepwise-external (squares) calibration are calculated from spectra acquired using a 1.0 V trapping potential, while the errors of low trapping potential external calibration (crosses) are calculated from spectra measured using a 0.63 V trapping potential.

FIG. 3(*a*) illustrates the root-mean-square error, FIG. 3(*b*) illustrates the average error, and FIG. 3(*c*) illustrates the standard deviation of noncalibrant masses for BSALow are plotted against total ion intensity for each spectrum. Errors of standard internal (open circles), modified internal (filled grey circles), modified global regression (circles with a cross), and modified stepwise-external (squares) calibration are calculated from spectra acquired using a 1.0 V trapping potential.

DETAILED DESCRIPTION

Figure 1:
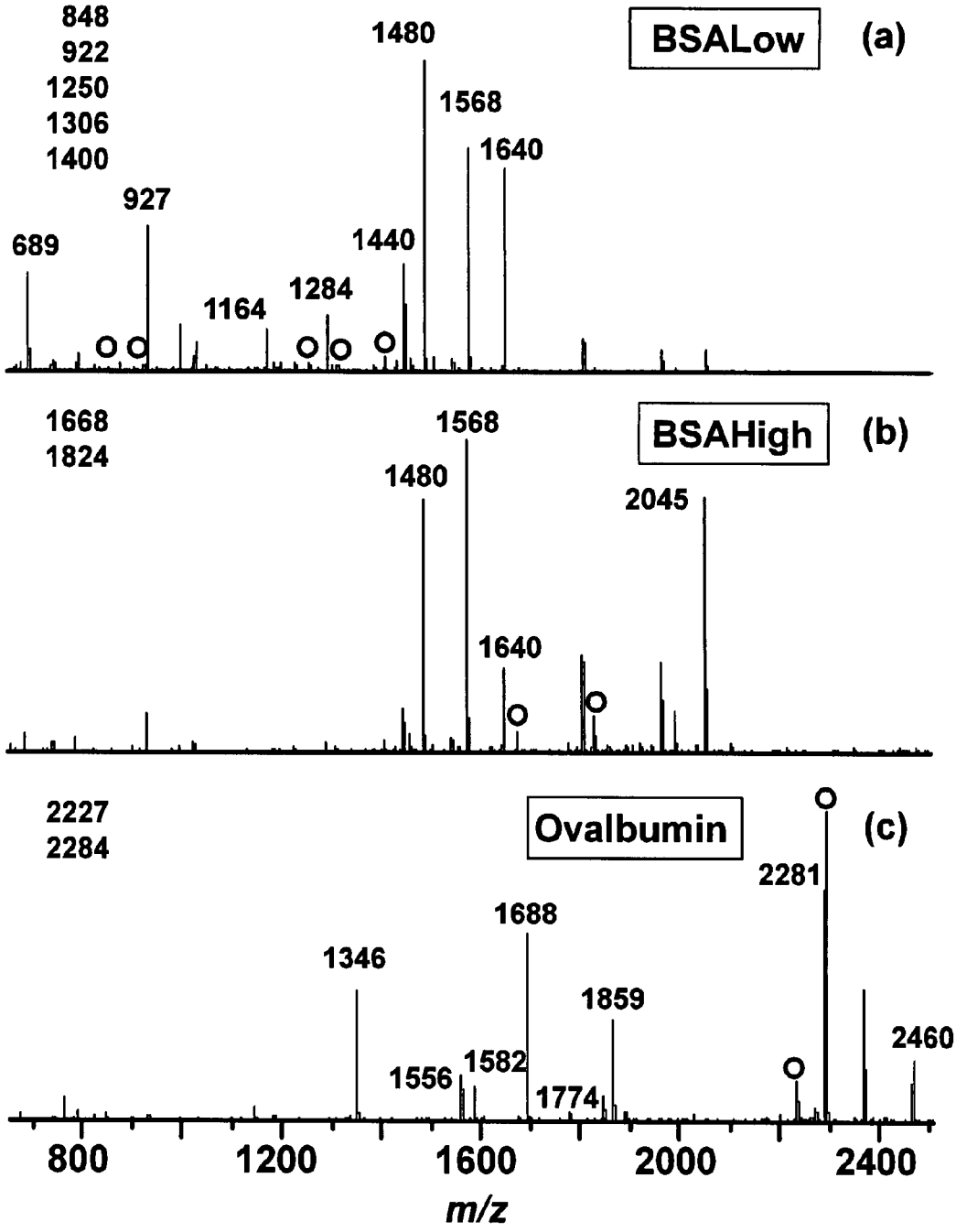
FIG. 1(*a*) illustrates a mass spectrum of BSA tryptic digest acquired using low mass enhancing conditions.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, inorganic chemistry, mass spectrometry, physics, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Mass spectrometry calibration methods are provided. In an embodiment, the mass spectrometry calibration method includes a two-step external calibration process. The two-step calibration process provides a mass accuracy that is comparable or better than mass accuracy using internal calibration methods and other external calibration methods. In addition, the two-step calibration process is less complex than other calibration methods and does not require additional software or hardware. Further, an embodiment of the present disclosure includes a calibration equation that corrects or adjusts for local space-charge effects, and the calibration equation can be incorporated into the two-step calibration method. Additional details about embodiments of the present disclosure are described in Example 1.

It should be noted that "mass calibration" refers to a procedure that determines the constants in the equation that converts the physical parameter that is measured into a mass-to-charge value. This is typically accomplished by acquiring a mass spectrum of a compound that produces a known mass-to-charge value in a mass spectrum, and then fitting the calibration equation for the instrument to the measured parameter for the ion and the known value of its mass-to-charge.

In general, the two-step calibration process includes, but is not limited to, using low trapping voltages that give low ion numbers to generate data that are used to make accurate mass measurements. Then, the two-step calibration process includes using higher trapping voltages that give high ion numbers to generate data that are used to obtain greater signal-to-noise values and/or a greater detection dynamic range. The two sets of data are used to provide accurate mass measurements to about sub part-per-million (ppm) (i.e., <1 ppm) mass accuracy.

The two-step calibration process can be used in mass spectrometry systems such as, but not limited to, ion trap mass analyzer systems (IT-MS), ion cyclotron resonance mass analyzer system (ICR-MS) (e.g., FTICR-MS), and orbitrap systems, as well as with other ion trapping systems. The mass spectrometry system source can include sources such as, but not limited to, electrospray ionization sources, atmospheric pressure chemical ionization sources, inductively coupled plasma ion sources, glow discharge ion sources, electron impact ion sources, laser desorption/ionization ion sources, radioactive sources, as well as other ion sources compatible with the mass spectrometry systems mentioned above. The two-step calibration process can be used in mass spectrometry systems that are operable in analyzing chemical compositions, biological compositions, polypeptides, polynucleotides, and the like.

In an embodiment, the two-step calibration process used to calibrate a mass spectrometry system includes the following steps. A first mass spectrum of a sample is acquired using a first trapping potential, and the masses are determined by standard external calibration using standards measured under identical conditions as the first mass spectrum. A low trapping potential is used to reduce space-charge effects that might otherwise degrade mass accuracy. A trapping potential is a voltage that is applied to the trapping electrodes of an analyzer cell, for example the trapping electrodes of the ICR analyzer cell. The trapping voltage creates a potential well that allows ions to be trapped in the analyzer cell, for example. A higher trapping voltage increases the ion capacity of the analyzer cell. The first mass spectrum is acquired from a low ion population. The phrase "low ion population" is a relative phrase that can be defined by comparison to a maximum ion population, which can be defined as the number of ions present at the charge capacity of the cell. A low ion population refers to the number of ions that is less than about 1/100th of the maximum ion population. The first mass spectrum includes a first set of mass ion values found in the first mass spectrum and a second mass spectrum (describe below). The mass ion values are selected from the monoisotopic peak of all isotopic clusters with a signal-to-noise value above 10:1. The mass-to-charge value of these peaks are determined by external calibration, and provide confidently-known masses that can serve as calibrants in the second mass spectrum, acquired at higher trapping potential.

A second mass spectrum of the sample using a second trapping potential is acquired. The second mass spectrum is acquired from a high ion population. The phrase "high ion population" is a population that lies within one order of magnitude of the maximum ion population. The second mass spectrum includes a second set of mass ion values. The second set of mass ion values includes all the peaks that were present in the first mass spectrum, plus additional peaks that result from the higher ion capacity of the analyzer cell that results from the selection of the second trapping potential. The set of peaks that are common to both sets of mass spectra (the masses which were determined with high confidence in the first mass spectrum) are used as an internal calibrant for the second mass spectrum.

The first trapping potential is lower than the second trapping potential. Typically the lower potential is less than 0.7 V and the higher potential is greater than 1.0 V. The exact values of trapping potential will depend on the mass spectrometer employed, but should be selected to produce at least an order of magnitude difference in the number of ions that are trapped in the analyzer cell between the high and low trapping potential measurements. It should be noted that the absolute value of each of the first and second trapping potential depends upon the mass spectrometry system as well as other experimental conditions. The first set of mass ion values is more accurate than the second set of mass ion values, embodiments of which are discussed in detail in Example 1. It should be noted that mass accuracy is defined as the difference in mass between a measured value and its value that is calculated based on the elemental composition of the compound. The second set of ion values has a better signal-to-noise value and a greater detection dynamic range than the first set of mass values, embodiments of which are discussed in detail in Example 1. The detection dynamic range is defined as the ratio of the abundances of the most intense signal to the least intense signal in a mass spectrum. The signal-to-noise is defined as the ratio of the height of a peak above the average value of the baseline to the peak-to-peak amplitude of mass spectrum in a region of mass-to-charge where no signal is present.

As mentioned above, the first set of mass values and the second set of mass values are used to calibrate the mass spectrometry system. In particular, the first set of mass values is used to calibrate the second set of mass values. It should also be noted that the mass accuracy could be adjusted for local space-charge effects using a calibration equation.

An exemplary embodiment of a method for adjusting for local space-charge effects would incorporate the use of a calibration equation. Typical calibration approaches are discussed in Eyler and coworkers [*J. Am. Soc. Mass Spectrom.* 1999, 10, 1291-1297], Smith and coworkers [*J. Am. Soc. Mass Spectrom.* 2002, 13, 99-106], and Muddiman and Oberg [*Anal. Chem.* 2005, 77, 2406-2414], each of which are incorporated herein by reference. In an embodiment, the modified calibration equation is the following:

$$\left(\frac{m}{z}\right)_i = \frac{A}{f_i + B + C \cdot I_i}$$

where $I_i$ is the intensity of an ion measured at frequency $f_i$ and has a mass of $(m/z)_i$. Parameter B corrects for the applied electric field (trapping potential) and global space-charge effects, while parameter A accounts for the magnetic field. Parameter C acts as a correction factor for local space-charge effects. Additional details regarding this calibration equation are provided in Example 1.

Another embodiment of a calibration equation includes the following:

$$\left(\frac{m}{z}\right)_i = \frac{A}{f_i + B + C \cdot I_i + D \cdot I_{total}}$$

where $I_{total}$ is the sum of all ion intensity in a spectrum and $I_i$ is the intensity of the peak of interest measured with cyclotron frequency $f_i$. Additional details regarding this calibration equation are provided in Example 1. It should be noted that other calibration equations could be used in embodiments of the present disclosure.

In an embodiment, the mass spectrometry system is the ICR-MS (e.g., FTICR-MS). The two-step calibration process used to calibrate the ICR-MS includes the following steps. A first mass spectrum of a sample using a first trapping potential is acquired. The first trapping potential is selected to permit external calibration with less than 1 ppm mass measurement accuracy. Generally, this requires a trapping potential that is less than 0.7 V, but the exact value will depend on the magnetic field strength and analyzer cell geometry and dimensions and the trapping potentials noted herein can vary from system to system. The first mass spectrum is acquired from a low ion population. The first spectrum includes a first set of mass ion values from each mass spectrum.

Then, a second set of mass spectra of the sample using a second trapping potential is acquired. The second trapping potential is selected to provide an order of magnitude increase in the number of ions that are trapped by the analyzer, and typically is 1.0 V or higher. A second mass spectrum is acquired from a high ion population. The second mass spectrum includes a second set of mass ion values. The trapping potentials noted above can vary from system to system.

The first set of mass ion values is more accurate than the second set of mass ion values. The second set of ion values has a greater signal-to-noise value and/or a greater detection dynamic range than the first set of mass values. The first set of mass values is used as internal mass standards to calibrate the second set of mass values. Embodiments of the present disclosure using FTICR-MS are provided in Example 1.

The two-step calibration process can be used to obtain sub parts-per-million mass accuracy, which is similar or better than over other external calibration methods and similar to internal calibration methods without sacrificing detection sensitivity and/or dynamic range.

EXAMPLES

Now having described the embodiments of the present disclosure, in general, Example 1 describes some additional embodiments of the present disclosure. While embodiments of the present disclosure are described in connection with Example 1 and the corresponding text and figures, there is no intent to limit embodiments of the present disclosure to these descriptions. On the contrary, the intent is to cover all alternatives, modifications, and equivalents included within the spirit and scope of embodiments of the present disclosure. Additional detail regarding Example 1 are described in Wong, R. L.; Amster, I. J., "Sub Part-Per-Million Mass Accuracy by Using Stepwise-External Calibration in Fourier Transform Ion Cyclotron Resonance Mass Spectrometry", *J. Am. Soc. Mass Spectrom.* 2006, 17, 1681-1691, which is incorporated herein by reference.

Example 1

Introduction

Embodiments of external calibration procedures for FT-ICR mass spectrometry are presented, stepwise-external calibration. This method is demonstrated for MALDI analysis of peptide mixtures, but is applicable to any ionization method. For this procedure, the masses of analyte peaks are first accurately measured at a low trapping potential (e.g., 0.63 V) using external calibration. These accurately determined (<1 ppm accuracy) analyte peaks are used as internal calibrant points for a second mass spectrum that is acquired for the same sample at a higher trapping potential (e.g., 1.0 V). The second mass spectrum has a 10 fold improvement in detection dynamic range compared to the first spectrum acquired at a low trapping potential. A calibration equation that accounts for local and global space charge is shown to provide mass accuracy with external calibration that is nearly identical to that of internal calibration, without the drawbacks of experimental complexity or reduction of abundance dynamic range. For the 609 mass peaks measured using stepwise-external calibration method, the root-mean-square error is 0.9 ppm. The errors appear to have a Gaussian distribution; 99.3% of the mass errors are shown to lie within 3 times the sample standard deviation (2.6 ppm) of their true value.

Discussion

Although protein identification can be classified into many categories, such as "top-down" versus "bottom-up" and shotgun methods versus peptide mass fingerprinting, protein identification is ultimately based on the mass measurement of proteins, peptides or their fragment ions. A greater confidence in the accuracy of the mass measurement can improve the identification rate and the confidence level of the assignments. Of all types of mass analyzers, Fourier-transform ion cyclotron resonance (FT-ICR) mass spectrometry provides the highest mass accuracy over a broad m/z range and the highest mass resolution, making identification of peptide elemental composition possible. Although sub part-per-million (ppm) mass accuracy can be achieved by FT-ICR, the typical accuracy level is usually in the 1-10 ppm range. For external calibration, the mass accuracy in a FT-ICR experiment depends on the number of ions in the analyzer cell because a space-charge frequency shift causes the observed cyclotron frequency to decrease with increasing ion population. Analyte separation prior to mass spectrometry is often necessary for proteome samples to reduce the sample complexity and to improve the detection dynamic range. However, the analyte ion production varies widely in liquid chromatography-mass spectrometry (LC-MS) experiments, and the ion population in the analyzer cell can fluctuate by two to three orders of magnitude, resulting in systematic mass measurement offsets. In fact, greater abundance dynamic range for proteomics can be achieved by increasing the separation power prior to mass spectrometry, but at the expense of greater fluctuations in the resulting ion population.

Ultrahigh mass accuracy in FT-ICR can be achieved using internal calibration with a small ion population, where space-charge frequency shifts can be treated with relatively simple equations [33,34]. Even though the average mass error is minimized in internal calibration experiments, the ion population needs to be kept low to reduce the data scattering [44], but this condition produces spectra of poor sensitivity and poor abundance dynamic range, in opposition to the essential demands of a proteome analysis. To accommodate higher ion populations, Eyler and coworkers [*J. Am. Soc. Mass Spectrom.* 1999, 10, 1291-1297] and Smith and coworkers [*J. Am. Soc. Mass Spectrom.* 2002, 13, 99-106] have incorporated ion intensity as part of the fitting parameters for the calibration equation developed by Gross and coworkers [*Anal. Chem.* 1984, 56, 2744-2748]:

$$\left(\frac{m}{z}\right)_i = \frac{A}{f_i} + \frac{B}{f_i^2} + C \cdot \frac{I_i}{f_i^2} \tag{1}$$

where $f_i$ is the measured cyclotron frequency for a calibrant ion at $(m/z)_i$, $I_i$ is the corresponding ion intensity, and A, B, C are the regression fitting parameters. A accounts for the magnetic field effect, B and C terms account for the global and local space-charge effects, respectively. The space-charge frequency shift caused by ions of the same m/z (local space-charge) is treated separately from the rest of the space-charge frequency shift (global space-charge) when used with internal calibration. This modified calibration equation has been shown to improve internal calibration mass accuracy by a factor of 1.5 to 6.7, depending on the calibration mass range and the ion excitation radius. The new calibration equation is especially useful for proteomic studies where a high ion population in the analyzer cell is essential to achieve a high dynamic range in the abundance scale. However, internal calibration for complex mixtures usually requires a specialized instrument setup, such as a dual-ESI ionization source or the means to accumulate ions desorbed from multiple MALDI sample spots. A high level of skill is required to properly implement such devices, and thus these techniques have not been widely adopted. Moreover, adding calibrant ions to the analyzer cell complicates the resulting mass spectrum, and raises the likelihood of mass overlap between analyte and calibrant species. Furthermore, it decreases the detection dynamic range by using some of the available charge capacity of the analyzer cell for non-analyte ions.

For external calibration, the space-charge effects on mass accuracy can be reduced by using a calibration curve of frequency shift versus ion population. Others have applied a global regression calibration approach by separately treating the total ion intensity from intensity of the ions of interest, and achieved a mass accuracy of <5 ppm using external calibration for polypropylene glycol. Nonetheless, making an accurate frequency shift/ion abundance curve can be time-consuming and the calibration curve is only suitable for a single set of experimental conditions. Another approach for external calibration is to precisely control the ion population in the analyzer cell using automatic gain control (AGC). Such an approach has been implemented on a commercial ESI-FTICR device and is claimed to routinely produce mass errors of less than 2 ppm. However, Smith and coworkers demonstrated that mass accuracy using AGC depends strongly on the selected abundance level of the ion population. The mass accuracy obtained with a high ion population in the analyzer cell is not as good as for a low population. The mass confidence levels using AGC are ~5 ppm for external calibration experiments. While AGC improves mass accuracy for ESI-FTICR experiments, the implementation is not suitable for pulsed ion sources. Other approaches are needed for attaining high mass accuracy in MALDI experiments.

Here, a two-step calibration procedure for FT-ICR is described in which can be readily applied to any complex analyte, which requires no specialized hardware such as is required for AGC, and which can be used for MALDI or ESI experiments. The analyte mass spectrum is first acquired using external calibration at a low trapping potential (0.63 V), which provides high mass accuracy, but low dynamic range for ion abundance. A second analyte mass spectrum is then acquired at a higher trapping potential (1.0 V), which significantly improves signal-to-noise and the dynamic range for abundance measurements. The mass values measured at the low trapping potential are used as calibration reference points for the second spectrum. This stepwise-external calibration method is tested on three different protein digest systems and compared to other calibration methods. Moreover, a new calibration equation that corrects for local space-charge is incorporated in the stepwise-external calibration approach and investigated. Stepwise-external calibration provides comparable mass accuracy to internal calibration without its experimental complexity or the other above-mentioned shortcomings.

Experimental

Materials and Sample Preparation 2,5-dihydroxybenzoic acid (DHB) and dithiothreitol (DTT) were purchased from Lancaster (Pelham, N.H.) and Sigma (St. Louis, Mo.), respectively. Trypsin, bovine serum albumin (BSA) and chicken egg albumin (ovalbumin) were purchased from Promega (Madison, Wis.), Sigma (St. Louis, Mo.), and Calbiochem (San Diego, Calif.), respectively. Protein samples were prepared at ~1 mg/mL concentration and denatured by heating at 90° C. for 5-10 minutes. Disulfide bonds were reduced using 5 mM DTT at 70° C. for 1 hour. Denatured proteins were digested overnight at 37° C. using trypsin at a 1:50 protease:protein ratio (by mass). 400 nL of the digested proteins was applied to a stainless steel matrix-assisted laser desorption/ionization (MALDI) plate and 400 nL of 1 M DHB prepared in 50:50:0.1% water:acetonitrile: trifluoroacetic acid solution (by volume) was added as the MALDI matrix.

Mass Spectrometry

Mass spectra were collected on a 9.4 tesla Bruker BioApex Fourier-transform ion cyclotron resonance (FT-ICR) mass spectrometer equipped with an intermediate pressure Scout 100 MALDI source. Ions generated from 5 MALDI laser shots were accumulated in a hexapole. Argon gas was pulsed into the source region during MALDI events to enhance ion accumulation in the hexapole and to reduce the kinetic and internal energy of the ions. The accumulated ions were released from the hexapole by reducing the voltage applied to the hexapole exit electrode, and were guided to the FT-ICR analyzer cell through a series of electrostatic ion optics. The mass range of the detected ions can be selected by varying the ion extraction time, that is, the period between the ejection of ions from the source hexapole and the beginning of ion excitation and detection. For acquisition of the BSA tryptic digest mass spectra, data were collected with ion extraction times of 2 ms and 4 ms to enhance the low and high mass ions, respectively. For acquisition of the ovalbumin digest mass spectra, data were collected using an ion extraction time of 4 ms only. Ions were excited using a chirp waveform (125 steps, 2 kHz/step, 0.32 μs/step, 40 μs total sweep time, sweep range 36088 Hz-294117 Hz, 400 $V_{p-p}$) and 1 Mpoint transients were acquired at an analog-to-digital conversion rate of 588 kHz. The data were apodized with a sinebell function and padded with one zero-fill prior to fast Fourier transformation and magnitude calculation to the frequency domain. The mass spectra collected using the above conditions have a lower mass limit of m/z 490. A few spectra were acquired using a lower mass limit of m/z 100 to ensure that matrix ions or other lower mass species were not transferred to the analyzer cell. Spot-to-spot variation in the MALDI process was used to generate mass spectra with a wide range of total ion intensities.

Stepwise Calibration

For stepwise external calibration, a mass spectrum is acquired at a trapping potential of 0.65 V. This mass spectrum is externally calibrated using the standard formula, equation 1. For the present work, the two calibration constants are obtained from a mass spectrum of a mixture of peptides of known composition from a protein proteolytic digest, but any mass standards are suitable, provided that the acquisition parameters are identical for the mass spectra of calibrant and the sample. A second mass spectrum of the same sample is next acquired at a trapping potential of 1.0 V. Generally, all of the peaks in the mass spectrum obtained in the first mass spectrum (0.65 V trapping potential) will appear in the second mass spectrum, and will have higher abundance than in the first mass spectrum, allowing one to easily correlate the peaks from the two mass spectra. In addition, many new low abundance peaks will appear in the second mass spectrum. An internal calibration is applied to the second mass spectrum, using the masses that were measured in the first mass spectrum. In the present work, from 12 to 15 peaks were selected as internal calibrants, leaving the remainder of the assignable peaks for testing the mass accuracy of the calibration method. In practice, all of the peaks in the first mass spectrum would be used as internal calibrants, as the resulting mass errors are reduced as the number of calibrant peaks increases. It is particularly useful to include both high and low abundance peaks when using equation 3 as the calibration formula, as this equation incorporates the intensity of a peak to account for local space charge effects. For internal calibration, linear regression is used to obtain the calibration constants by fitting the measured frequencies and intensities to the masses that are determined from the first mass spectrum, using the Microsoft Excel LINEST function.

Results and Discussion

To investigate the reliability of various calibration methods, tryptic peptides of bovine serum albumin (BSA) and chicken egg albumin (ovalbumin) are studied using MALDI-FTICR. By changing the time delay between ion introduction and cell accumulation, the range of masses that are trapped can be selected. Tryptic fragments of BSA are detected by using low and high mass selective enhancement, as shown in FIGS. 1*a* and 1*b*, while ovalbumin fragments are detected using the high mass selective enhancing condition. For clarity of discussion, BSA mass spectra generated using the low and high mass enhancing conditions are denoted as BSALow and BSAHigh, respectively. The mass peaks marked with numerical values and open circles in FIG. 1 correspond to predicted tryptic peptides. Peaks marked with their nominal mass values are used for calibrant points and for mass accuracy assessment, and those marked with open circles are treated as analyte peaks to test the mass accuracy. Twenty one mass spectra are collected for BSALow, BSAHigh and ovalbumin at 1.0 V and 0.63 V cell trapping potential—a total of 126 spectra. Unless specified, mass spectra discussed are acquired at a 1.0 V trapping potential.

Stepwise-external calibration is based on the observation that the best mass accuracy for FT-ICR is obtained when the trapping potential and ion population are low. By using low trapping potentials, the ion capacity of the cell is reduced significantly, so that a low population of ions is obtained even for high sample concentrations. By capping the upper limit of ion abundance, space charge induced frequency shifts are significantly reduced. Highly accurate mass values can be obtained using external calibration at a low trapping potential (0.63 V for this experiment), but mass spectra obtained in this manner have reduced signal-to-noise and abundance dynamic range due to the smaller ion capacity of the analyzer cell. In addition, the relative abundances of the peaks are more susceptible to statistical fluctuation, and are less reliable for quantification. To recover the lost dynamic range and to maintain high mass accuracy, a new mass spectrum is acquired for the same sample at a higher trapping potential (1.0 V), and the mass values measured using the low trapping potential are used as calibration reference masses for the spectrum acquired at the higher trapping potential. This stepwise-external calibration mimics internal calibration via calibrating with mass peaks that lie within the analyte spectra. However, the peaks used for calibration are also analyte ions, and the reference mass values are obtained from a separately acquired spectrum using external calibration at a low trapping potential. In the present work, stepwise-external calibration is compared to conventional external calibration and internal calibration. In this study, the spectrum having the lowest total ion intensity within each category is used as the reference spectrum for conventional external calibration, to provide calibration parameters for the other spectra. Internal calibration is performed when spectra are calibrated on their known peaks, that is, the peaks labeled with numbers in FIG. 1.

The accuracy of the stepwise-external calibration method largely depends on its first step: the ability to measure accurate mass values for the analyte at a low trapping potential via external calibration. To estimate the accuracy level of this step, 21 mass spectra are acquired using a low trapping potential (0.63 V) for each protein digest system. The spectrum having the lowest total ion intensity is used as the external calibration reference spectrum for the other 20 spectra, and the calibrated mass values of the highest ion intensity spectrum are used as the reference masses for spectra acquired at a higher trapping potential. This provides a "larger than average" space-charge effect for spectra measured at the low trapping potential, and therefore tests the robustness of the stepwise-external calibration method.

To examine mass accuracy in a systematic fashion, the root-mean-square (RMS) of the errors, the average error (AVE), and the population standard deviation (S.D.) of the errors are calculated for each spectrum. The three terms are expressed as follows:

$$RMS = \sqrt{\frac{\sum_i (\text{mass } error_i)^2}{n}}$$

-continued $$AVE = \frac{\sum_i \text{mass } error_i}{n}$$

$$S.D. = \sqrt{\frac{\sum_i (\text{mass } error_i - AVE)^2}{n}}$$

where i is the index number for mass peaks, n is the total number of data, and mass error is expressed in parts-per-millions (ppm). The RMS error value indicates the accumulated error in a mass spectrum. The AVE error reflects the average position of the errors, allowing cancellation between positive and negative errors, while the S.D. value accounts for the discrepancy within the data. The population standard deviation expression is carefully chosen over the sample standard deviation because these S.D. values are not used for estimating confidence limit for the population. Instead, the S.D. values are used to represent the "non-average error." The three terms are directly related by the equation: $RMS^2=AVE^2+S.D.^2$.

Errors for the Calibrant Points in BSALow

Figure 2:
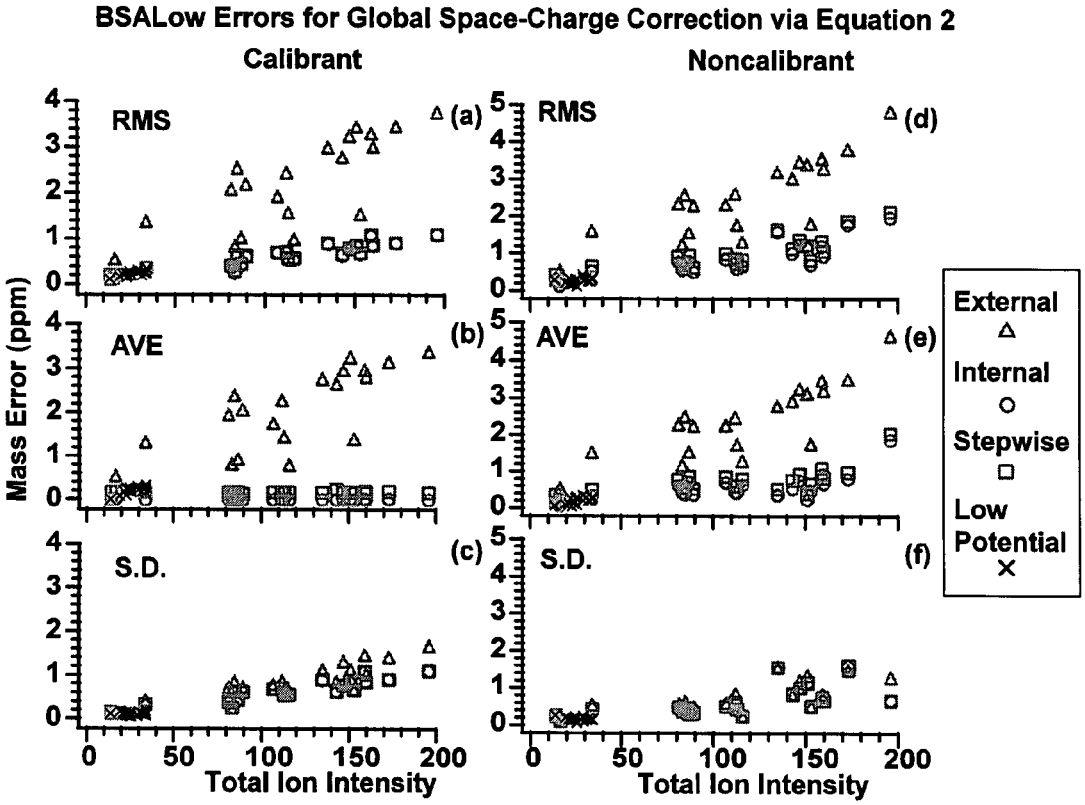
FIG. 2 illustrates error analysis for BSALow calibrant and noncalibrant masses accounting for global space-charge effects.

External calibration, internal calibration, and stepwise-external calibration methods were examined for BSALow at a 1.0 V trapping potential, which has 8 calibrant masses, ranging m/z 689-1640 (FIG. 1*a*). The standard calibration equation used is developed by McIver and coworkers [*Int. J. Mass Spectrom. Ion Processes* 1983, 54, 189-199]:

$$\frac{m}{z} = \frac{A}{f + B} \tag{2}$$

where f is the measured cyclotron frequency, m/z is the mass-to-charge value, and A and B are fitting parameters. For internal calibration experiments, parameter A of equation 2 accounts for the magnetic field, while B accounts for the electric field from the trapping potential and from global space-charge effects. The B term is always negative because the electric field from the trapping potential or the global space-charge effects decreases the observed cyclotron frequency. Mass errors are calculated for the 8 calibrant peaks for the various calibration methods. The RMS, AVE and S.D. of the errors for each spectrum are plotted against the total ion intensity for the four calibration methods in FIGS. 2*a*-2*c*. The RMS error is largest with external calibration (triangles), and displays a strong dependence on the total ion intensity (FIG. 2*a*), whereas the RMS errors for internal (circles) and stepwise-external (squares) calibration are essentially the same and have a much smaller dependence on the ion intensity. The external calibration obtained at a low trapping potential (crosses) spans a very narrow range of ion intensity and produces the smallest errors of the four methods. These results indicate that accurate masses are obtained via external calibration at a low trapping potential. The large RMS error for the external calibration data is largely due to global space-charge effects, where the measured cyclotron frequency for an ion decreases with increasing ion population in the analyzer cell. This effect is more clearly observed in the plot of AVE error versus total ion intensity, FIG. 2*b*. The magnitudes of the RMS (triangles in FIG. 2*a*) and AVE (triangles in FIG. 2*b*) errors are similar for external calibration, indicating that a majority of the RMS error is due to AVE error, consistent with the constant error expected from the global space-charge effects. At the same time, the AVE errors for the internal (circles) and stepwise-external (squares) calibration are essentially independent of the ion intensity in FIG. 2*b*, suggesting the two calibration methods are sufficient for minimizing the space-charge induced errors for these calibrant masses. The AVE error for stepwise-external calibration has a small constant offset because the calibrant mass values derived using external calibration at the low trapping potential also have a small offset.

The main source of mass errors for internal and stepwise-external calibration is the result of data scattering, as the RMS plots are similar to the S.D. plots for these two calibration methods (circles and squares in FIGS. 2*a* and 2*c*). The S.D. errors for the external, internal and stepwise-external calibration methods are very similar and show a small positive relationship with total ion intensity (FIG. 2*c*), suggesting equation 2 becomes less accurate for describing the mass-to-frequency relationship at high ion abundance.

Local Space-Charge Effects on Mass Accuracy

If local space-charge effects play a role in controlling mass accuracy, then standard calibration equation 2 will be insufficient for the prediction of mass values of peaks with large intensity differences from the calibrant peaks. To test this theory, 5 peaks with low intensity (circles) were selected from the mass spectrum shown in FIG. 1*a*. The RMS errors for these noncalibrant peaks are shown in FIG. 2*d*, and are seen to be larger than those of the calibrant points in FIG. 2*a*. This is consistent with local space-charge effects that are unaccounted for via standard calibration equation 2, however it could also result from the data regression procedure. Since calibration is performed using least-squares regression on the calibration reference points, the mass peaks that are directly calibrated generally have errors smaller than other peaks in the same mass spectrum. However, the AVE error plots in FIG. 2*e* strongly suggest one must account for local space-charge effects in order to accurately measure the low abundance peaks. Not only are the AVE errors for internal (circles) and stepwise-external (squares) calibration in FIG. 2*e* much greater than those in FIG. 2*b*, but the AVE errors for the noncalibrant peaks actually increases with the total ion intensity of the spectra. One explanation for this observation is that space-charge forces are smaller between ions of the same m/z than between ions of different m/z, resulting in a smaller space-charge frequency shift for the more intense calibrant peaks. Using the intense peaks for calibration reference points underestimates the frequency shift for the less intense ions. Consequently, the space-charge induced mass errors are only partially corrected in the case of the low abundance ions, resulting in a small dependence on ion abundance. The S.D. errors are similar for the three calibration methods suggesting that the data scattering is the same for three approaches (FIG. 2*f*). The RMS, AVE and S.D. errors are very small for external calibration data collected at a low trapping potential (crosses in FIGS. 2*d*-2*f*), where the range of ion intensities is small. These results again suggest the global and local space-charge effects are minimal at low ion abundance conditions, and thus the measured masses obtained at a low trapping potential serve as good reference masses.

To achieve better mass accuracy, we have tested calibration equations that account for local space-charge effects. The two calibration approaches utilized are based on the modified calibration equation demonstrated by Eyler and coworkers [*J. Am. Soc. Mass Spectrom.* 1999, 10, 1291-1297, which is incorporated herein by reference] and Smith and coworkers [*J. Am. Soc. Mass Spectrom.* 2002, 13, 99-106, which is incorporated herein by reference], and a new implementation by Muddiman and Oberg [*Anal. Chem.* 2005, 77, 2406-2414, which is incorporated herein by reference]. In our study, the modified calibration equation is an extension of the calibration equation 2:

$$\left(\frac{m}{z}\right)_i = \frac{A}{f_i + B + C \cdot I_i} \tag{3}$$

where $I_i$ is the intensity of an ion measured at frequency $f_i$ and has a mass of $(m/z)_i$. As mentioned above, parameter B corrects for the applied electric field (trapping potential) and global space-charge effects. Parameter C acts as a correction factor for local space-charge effects. Although the expression of equation 3 differs from that of equation 1, the calibration results are similar. For the 21 spectra of BSALow, the internal calibration RMS errors for the calibrant peaks using equation 1 and equation 3 are 0.63 ppm and 0.64, respectively, and 0.93 ppm and 0.91 ppm, respectively for the noncalibrant points. The close agreement between the two forms of equation is expected. Marshall and coworkers have demonstrated that the two calibration equations developed by McIver and coworkers and Gross and coworkers produce essentially the same mass accuracy result [*Int. J. Mass Spectrom.* 2000, 196, 591-598, which is incorporated herein by reference]. For this calculation, the stepwise-external calibration approach is modified to mimic a more realistic situation by using additional detectable peaks (not noncalibrant peaks) collected at the low trapping potential as calibration reference masses. The identities of these peaks are inconclusive but they consistently appear in every spectrum. A main advantage of stepwise-external calibration over internal calibration is that no calibrant is added to the sample. Therefore, in a real stepwise-external calibration experiment, all detectable peaks obtained at a low trapping potential are equally good and are used as calibration reference masses. This modification provides stepwise-external calibration with more reference points over a wider intensity range.

The other approach is a global regression calibration method similar to that implemented by Muddiman and Oberg. Instead of applying equation 3 to each individual spectrum, a global regression is preformed on all available spectra, in this case, the 21 spectra of BSALow. The global regression calibration equation is:

$$\left(\frac{m}{z}\right)_i = \frac{A}{f_i + B + C \cdot I_i + D \cdot I_{total}} \tag{4}$$

where $I_{total}$ is the sum of all ion intensity in a spectrum and $I_i$ is the intensity of the peak of interest measured with cyclotron frequency $f_i$.

Figure 3:
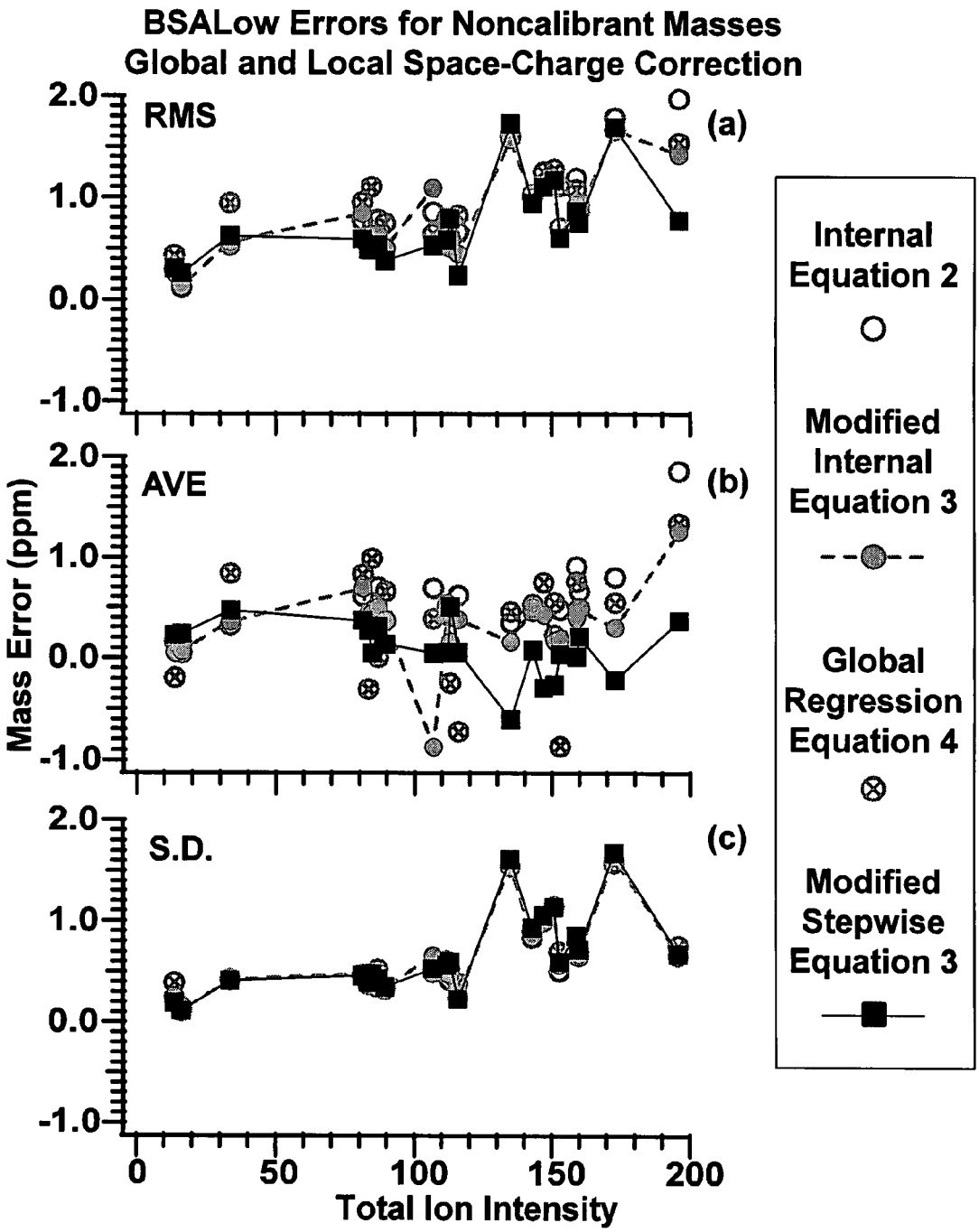
FIG. 3 illustrates the improvement of mass errors for BSALow by accounting for local space-charge effects using equation 3.

FIG. 3 shows the RMS, AVE, and S.D. errors of the noncalibrant points for internal calibration using standard calibration equation 2 (open circles) and modified equation 3 (filled circles), for global regression using equation 4 (circles with a cross) and for stepwise-external calibration using modified equation 3 (squares). The RMS errors are similar for the four methods, although the errors derived from standard calibration equation 2 (open circles) and global calibration equation 4 (circles with a cross) are marginally worse. The improvement obtained by using the modified equation 3 is shown in FIG. 3*b*, where the AVE errors are smaller for modified internal calibration (filled circles) and modified stepwise-external calibration (squares) comparing to the data derived from the standard internal calibration method (open circles). The low AVE error obtained for modified stepwise-external calibration shows that the systematic error associated with space-charge effects has been reduced to a fraction of the S.D. error of the measurement (FIG. 3*c*). These results show that the space-charge frequency shifts of the low abundance peaks are properly accounted for by using modified equation 3, even though they were not used as calibrant points.

Figure 4:
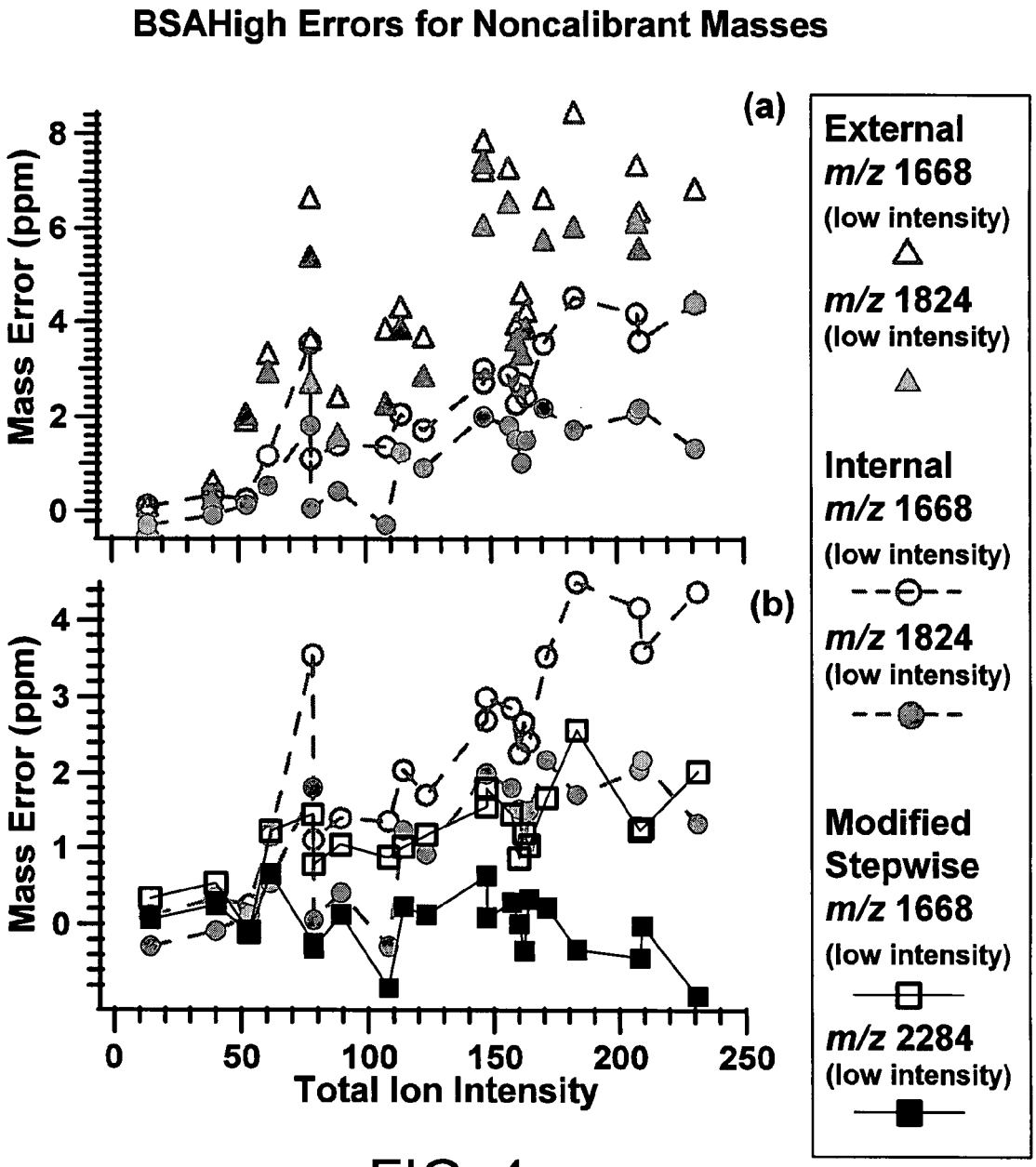
FIG. 4 illustrates the error analysis comparison for two low intensity peaks. The mass errors of the noncalibrant peaks of m/z 1668 (open symbols) and 1824 (filled symbols) are plotted against total ion intensity for FIG. 4(*a*) comparing external calibration (triangles) to standard internal calibration (circles), and FIG. 4(*b*) comparing standard internal calibration (circles) to modified stepwise-external calibration (squares).

A similar analysis is conducted for BSA fragments in which the heavier ions (m/z 1470-2050) shown in FIG. 1*b* are selectively trapped and detected. Because the noncalibrant peaks constitute the greater challenge, only their errors are discussed. As illustrated in FIG. 1*b*, the ion intensities of the four calibrant peaks are noticeably higher than those of the two noncalibrant peaks (m/z 1668 and m/z 1824). In FIG. 4*a*, the mass errors of the two noncalibrant peaks are individually plotted against total ion intensity for external calibration and internal calibration using standard calibration equation 2. The mass errors from external calibration (triangles) are reduced when internal calibration (circles) via equation 2 is used, but most of the mass errors are positive, indicating a systematic mass shift is still the main source of errors. The effect is due to space-charge effects that are not effectively corrected when the calibration is applied to the low abundance peaks. The mass errors are noticeably reduced when modified calibration equation 3 is used for stepwise-external calibration (squares) in FIG. 4*b*. Much of this improvement is due to better treatment of the local space-charge effects for the stepwise-external approach. Similar to the AVE error of BSALow shown in FIG. 3*b*, the mass errors of BSAHigh obtained using the modified stepwise-external calibration (squares) displays a smaller total ion intensity dependence than internal calibration using modified equation 3 (data not shown), illustrating the benefit of using additional calibrant points in stepwise-external calibration to offset the small error in the reference masses. To test this theory, errors were examined when the reference masses were limited to those used in the internal calibration for BSALow and BSAHigh. In these test cases, the modified stepwise-external calibration results became slightly worse than the modified internal calibration results, proving that the additional data points are beneficial. It is important to reiterate that in a typical complex spectrum with a complex mixture, stepwise-external calibration has the advantage of using any detectable peak at a low trapping potential for calibration and therefore spanning essentially the entire abundance dynamic range of the data. Nevertheless, mass error still increases with total ion intensity using the modified calibration. Since the average of mass errors has already been minimized for mass peaks with different ion abundance, the error spread is probably due to a higher order of effect which cannot be accounted via modified equation 3. One possible contribution for this error is that the ion excitation is performed using a chirp waveform which may not excite all ions to the same radius. Smith and workers have demonstrated that random mass errors are reduced by using a stored waveform inverse Fourier-transform (SWIFT) excitation.

Figure 5:
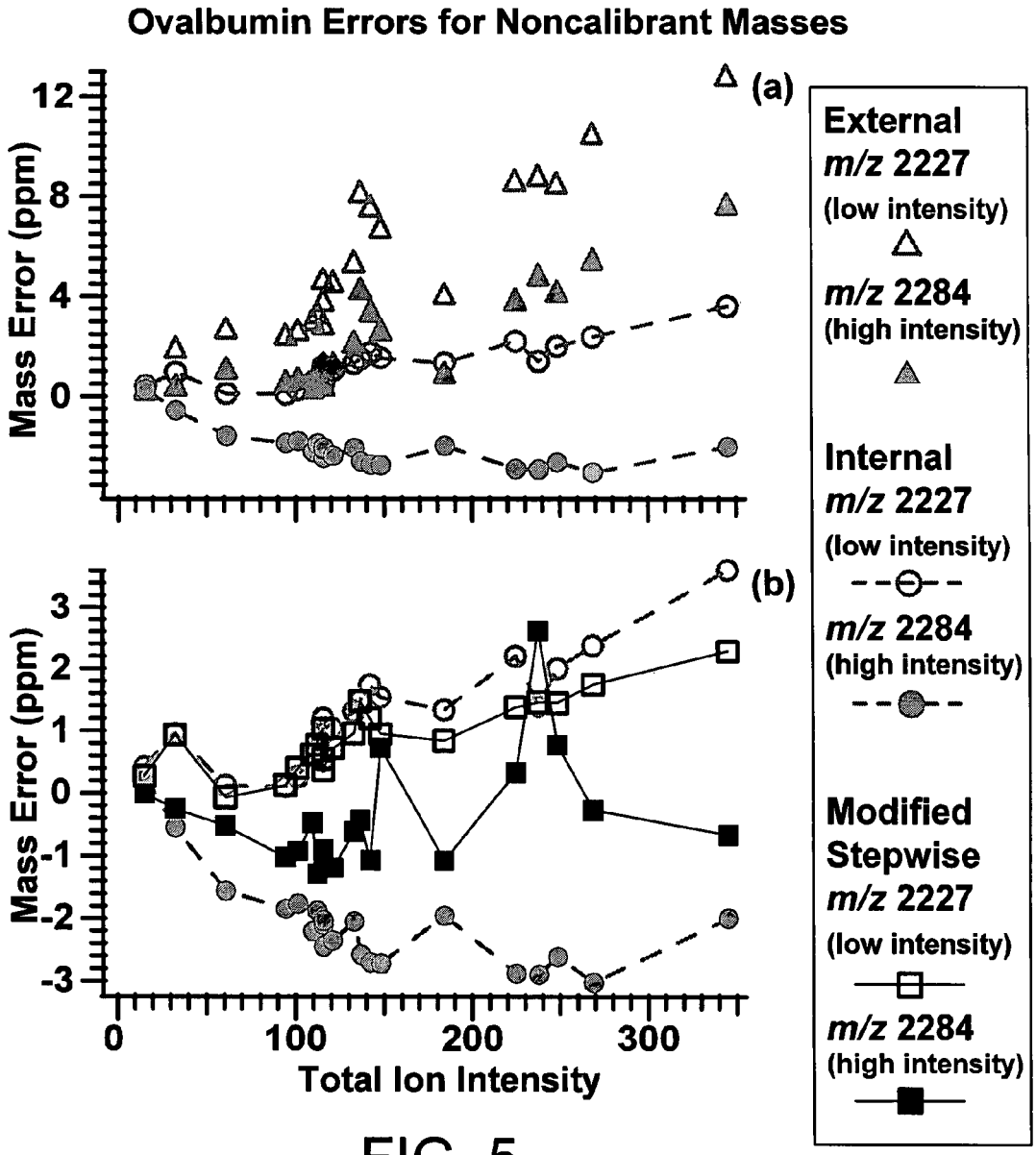
FIG. 5 illustrates the error analysis comparison for a low intensity versus a high intensity peak. The mass errors of the noncalibrant peaks of m/z 2227 (open symbols) and 2284 (filled symbols) are plotted against total ion intensity for FIG. 5(*a*) comparing external calibration (triangles) to standard internal calibration (circles), and FIG. 5(*b*) comparing standard internal calibration (circles) to modified stepwise-external calibration (squares).

The tryptic digest fragments of ovalbumin (m/z 1340-2460) were used to verify the calibration methods. As shown in FIG. 1*c*, eight known fragment masses are chosen for internal calibration reference points, and two noncalibrant peaks are chosen, one low (m/z 2227) and one high (m/z 2284) intensity peak. In FIG. 5*a*, the mass errors for the two tryptic peptides are individually plotted against total ion intensity for external calibration and internal calibration using standard equation 2. The mass error of m/z 2227 (open triangles) is noticeably larger than the error of m/z 2284 (filled triangles) at any given total ion intensity. This result is consistent with local-space charge effects, where m/z 2227 (open triangles) is the lower abundance ion and experiences a stronger space-charge effect. The mass errors for the two peptides are reduced using internal calibration via the standard equation (open and filled circles in FIG. 5*a*). The global space-charge effects are largely eliminated, as the errors for the two peptides center around 0 ppm. However, the spread of the errors between the two peptides is not reduced. In FIG. 5*b*, the mass errors of the two peptides are plotted against total ion intensity for standard internal calibration (open and filled circles) and modified stepwise-external calibration (open and filled squares). Although both calibration equations are able to center the errors at 0 ppm, the mass error difference between the two peptides is reduced using modified equation 3 (open and filled squares). Therefore, modified equation 3 reduces the error spread within each spectrum, an effect which is also observed for BSALow and BSAHigh in FIGS. 3*b* and 4*b*.

Errors for All Peaks

Figure 6:
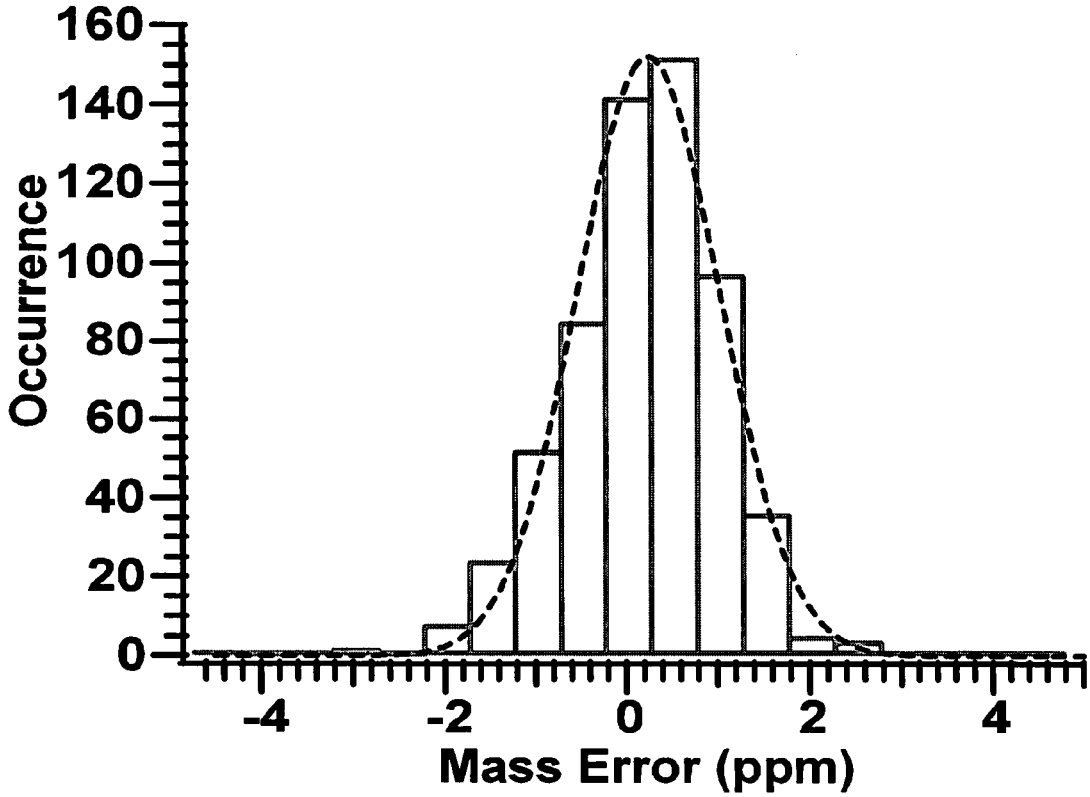
FIG. 6 illustrates a histogram of mass measurement error. The 609 mass values measured from BSALow, BSAHigh, and ovalbumin experiments using stepwise-external calibration are plotted. The dashed line corresponds to a Gaussian distribution fitting of the histogram data.

For all 609 known peaks of BSALow, BSAHigh, and ovalbumin measured using a 1.0 V trapping potential, the RMS error is highest for external calibration, having a value of 3.4 ppm, whereas the RMS values for internal, modified internal and modified stepwise-external calibration methods are 1.2 ppm, 0.9 ppm and 0.9 ppm respectively. The mass accuracy is not limited by the small error resulting from using pseudo-calibrants, i.e. masses determined by external calibration in the low trapping potential mass spectrum rather than by calculation from knowledge of their elemental composition. The pseudo-calibrants are measured with an average accuracy of 0.2-0.3 ppm (see FIGS. 2, 3 and 5), considerably smaller than the error obtained after stepwise calibration of the mass spectrum obtained at high trapping potential (ca. 1 ppm). The stepwise-external calibration approach improves mass accuracy compared to conventional external calibration and provides comparable mass accuracy to internal calibration. The error distribution of stepwise-external calibration measurement is shown in FIG. 6 using a 0.5 ppm bin size. The data closely resembles a Gaussian distribution (dashed line) with a small average offset of 0.14 ppm, because the reference masses are not exact, but are measured values obtained from an externally calibrated mass spectrum. The RMS and the sample standard deviation values are 0.86 ppm and 0.85 ppm, respectively. Strictly speaking, the Gaussian estimation of confidence limit is only appropriate in the absence of systematic error, and therefore cannot be guaranteed in external calibration experiments. Nevertheless, our data have shown that the AVE error is a very small portion of the RMS error. Using the Gaussian distribution as a model, 99.7% of the absolute errors are estimated to be $\leqq$2.6 ppm (3 times the sample standard deviation). From the actual data, only 4 peaks out of the total 609 peaks have mass error >2.6 ppm using stepwise-external calibration, corresponding to 99.3% of the errors lying within 2.6 ppm of the true value, close to the expected value of 99.7% for a true Gaussian distribution.

Advantages of Stepwise-External Calibration

A significant advantage of internal calibration versus external calibration is that mass accuracy can be estimated for an individual spectrum, a feature, which is also inherited by stepwise-external calibration. Although the mass errors of noncalibrant peaks are generally larger than those of the calibrant peaks, a strong correlation exists between the two sets of errors. For instance, spectra with higher RMS error for the calibrant peaks in FIG. 2*a* also display higher RMS error for the noncalibrant peaks in FIG. 2*d*. Therefore, the mass accuracy for internal and stepwise-external calibration experiments can be estimated on an individual spectrum basis, whereas the mass confidence in an external calibration experiment is usually estimated based on the largest errors from an ensemble of mass spectra. Consequently, the mass confidence of external calibration is always lower than that of internal and stepwise-external calibration.

Stepwise-external calibration avoids many challenges encountered in internal calibration experiments, such as ion suppression and spectral complexity introduced by the calibrant. For the 189 noncalibrant masses, the RMS errors of modified internal calibration and modified stepwise-external calibration are 1.2 ppm and 0.9 ppm, respectively. To take advantage of modified calibration equation 3, the calibrant species must span the analyte ions in both the mass range and the intensity range, and stepwise-external calibration is able to achieve this better by providing more calibrant points. As mentioned earlier, the stepwise calibration results are slightly worse when the calibrant points are limited to be the same as the ones used for internal calibration. Conversely, the mass accuracy for internal calibration can be improved when the calibrant species spans the analyte ions in both the mass range and the intensity range. However, this posts a significant challenge for proteomic mass spectrometry because separation is essential. The internal calibrant can only be added after the separation step, for example a dual-ESI source or sequential MALDI ion accumulation, but the "proper" amount of calibrant ions to be added to the analyte is difficult to control when the total analyte ion signal varies 2 orders of magnitude or higher as during a typical LC experiment. While a complex calibrant may satisfy these requirements, it will further compete with the proteome analyte for the finite ion capacity in the analyzer cell, and will diminish the useful abundance dynamic range. Stepwise-external calibration avoids this challenge by providing the means to calibrate using only the analyte peaks.

The global regression approach using equation 4 is based on the concept that the space-charge frequency shift relationship can be obtained via a series of mass spectra having different ion intensities. Up to this point, the mass errors of the global regression method are calculated under an idealized situation, where the mass distributions of the analyte and calibrant are the same. To better understand the mass confidence of this global regression approach, the 21 BSALow spectra are calibrated using the three sets of fitting parameters obtained from the BSALow, BSAHigh and ovalbumin spectra. Only the mass errors for m/z 1480, 1568 and 1640 ions are examined because these masses are covered within the three calibration ranges of BSALow, BSAHigh, and ovalbumin. The RMS error of the 21 BSALow spectra is 1.0 ppm when calibrated based on the BSALow fitting parameters, and increases to 1.5 ppm and 2.9 ppm when using the BSAHigh and ovalbumin fitting parameters, respectively. The mass accuracy obtained by using the global regression method is highly dependent on the similarity between mass distributions of the analyte and the calibrant spectra and therefore impossible to estimate for all cases. The realistic mass error will certainly be greater than those shown in FIG. 3. For comparison, a similar test is performed for stepwise-external calibration using BSALow, where the reference mass spectrum acquired at the low trapping potential is calibrated based on another BSALow spectrum, a BSAHigh spectrum, and an ovalbumin spectrum. The three resulting BSALow reference mass lists are essentially the same. The same RMS error (0.78 ppm) is obtained for the 21 spectra of BSALow using any of the three reference mass lists. In fact, the BSALow reference mass values acquired from the BSAHigh and ovalbumin spectra are extrapolated outside of their calibrant ranges (FIG. 1), demonstrating that data extrapolation is more reliable using a low trapping potential and that the calibrant spectrum need not to have the same m/z distribution as the analyte spectrum. Stepwise-external calibration is able to avoid many difficulties associated with calibrating analyte spectra of very different mass distributions because the spectra are measured under near-ideal conditions in the first step using a low trapping potential. In short, the fitting parameters B and C are minimized for equation 3. The stepwise-external calibration method is developed for complex mixtures, like proteomes, where many difficulties are magnified for conventional external calibration and conventional internal calibration approaches. However, the advantages of this method decrease when applied to less complicated samples. In the limit of studying a single compound sample, the stepwise-external calibration method offers no advantage.

Dynamic Range

The highest abundance peaks, measured at 0.63 V and 1.0 V trapping potential, are used for assessing the detection dynamic range improvement for the BSALow, BSAHigh, and ovalbumin experiments. These show an average increase in dynamic range by factors of 13, 5, and 9, respectively. The dynamic range improvement for BSALow is approximately the same as ratio of the total ion signal for the two trapping potential settings in FIG. 2 (data not shown for BSAHigh and ovalbumin). Although stepwise-external calibration doubles data acquisition time, there is a vast improvement in the data that compensates for the extra effort. For a given level of mass accuracy, the abundance dynamic range of usable mass spectra increases. Taking BSALow and BSAHigh data as examples, if a RMS error limit of <2.0 ppm is required, then only data with total intensity less than 50 arbitrary counts are reliable using external calibration (triangles in FIGS. 2*d* and 4*a*), whereas data with intensity value within 250 arbitrary counts are reliable for the stepwise-external calibration approach (squares in FIGS. 3*a* and 4*b*). This effectively improves the dynamic range of usable spectra by a factor of 5: The dynamic range of total ion intensity among all spectra is best estimated using the lowest total ion intensity in the low trapping potential experiment to the highest total ion intensity in the high trapping potential experiment. The estimated total ion abundance dynamic ranges are 25, 19, and 40 for BSALow, BSAHigh, and ovalbumin experiments, respectively (data not shown). Although this dynamic range is lower than the typical 100-1000 range reported in shotgun proteomic experiments, it is important to point out that mass error is also affected by the maximum ion population. The high trapping potential used (1.0 V) is representative for a typical experiment and therefore the ion signal in this study is representative for the maximum total ion abundance in a typical experiment. As such, a greater abundance dynamic range can only be achieved by lowering the total ion population in the lowest abundance spectrum, and the difference in the space-charge frequency shift will be minimal. For example, the space-charge frequency shift between mass spectra of total ion signal of 30 and 1 (dynamic range of 30), is expected to be similar to that between spectra of total ion signal of 30 to 0.1 (dynamic range of 300). The additional 10 fold increase in dynamic range will only increase the frequency shift by an additional of 3% (using the first-order space charge approximation).

CONCLUSIONS

Examples of high mass accuracy by FTICR-MS have been shown elsewhere, but these are often obtained using experimental conditions that are not optimal for high abundance dynamic range or high sensitivity. To advance the application of FT-ICR mass spectrometry for high-throughput proteomics, it is important to define procedures that achieve high mass accuracy on a routine basis. Stepwise-external calibration is a simple procedure which does not require special software or hardware, and that can be adapted with any calibration equation. In stepwise-external calibration, accurate mass measurement is achieved in the first step by using a low trapping potential (high mass accuracy mode), albeit under conditions that give sub-optimal sensitivity and reduced abundance dynamic range. The signal-to-noise and mass distribution are recovered in a second step by using a higher trapping potential (high abundance dynamic range mode). Of course, the mass accuracy that is obtained by using stepwise-external calibration will depend on experimental conditions, and will vary for different instruments, different samples and different calibration equations. The data presented here are for ions with mass-to-charge values less than m/z 2500, typical of peptides from a tryptic digest. Larger mass errors may result for higher m/z ions. Although we have only demonstrated advantages of the stepwise-external calibration for FT-ICR mass spectrometry in this paper, the approach should be applicable to other mass spectrometry methods, especially quadrupole ion trap and orbitrap mass spectrometry where space-charge effects also limit mass accuracy.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x'to about 'y'".

Many variations and modifications may be made to the above-described embodiments. All such modifications and variations are intended to be included herein within the scope of this disclosure and protected by the following claims.

We claim:

1. A method of calibrating a mass spectrometry system, comprising:

acquiring a first mass spectrum of a sample using a first trapping potential, wherein the first mass spectrum are acquired from a low ion population, wherein the first mass spectrum include a first set of mass ion values; and acquiring a second mass spectrum of the sample using a second trapping potential, wherein the second mass spectrum is acquired from a high ion population, wherein the second mass spectrum includes a second set of mass ion values, wherein the first trapping potential is lower than the second trapping potential, wherein the first set of mass ion values are more accurate than the second set of mass ion values, wherein the second set of ion values have a greater signal-to-noise value and a greater detection dynamic range than the first set of mass values, and wherein the first set of mass values are used to calibrate the second set of mass values.

2. The method of calibrating a mass spectrometry system of claim 1, further comprising:

adjusting mass accuracy for local space-charge effects using a calibration equation.

3. The method of calibrating a mass spectrometry system of claim 1, wherein the mass spectrometry system is selected from an ion trap mass analyzer system (IT-MS), an ion cyclotron resonance mass analyzer system (ICR-MS), and an orbitrap system.

4. The method of calibrating a mass spectrometry system of claim 3, wherein the mass analysis system is the ICR-MS, and wherein the first trapping potential is from about 0 to 0.75 V and the second trapping potential is from about 0.75 to 5 V.

5. The method of calibrating a mass spectrometry system of claim 1, wherein high ion population is an order of magnitude greater than the low ion population.

* * * * *